US006196657B1

(12) United States Patent
Hawkins et al.

(10) Patent No.: US 6,196,657 B1
(45) Date of Patent: Mar. 6, 2001

(54) MULTI-FLUIDIC CLEANING FOR INK JET PRINT HEADS

(75) Inventors: Gilbert A. Hawkins, Mendon; Michael E. Meichle, Rochester; Ravi Sharma, Fairport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/334,374

(22) Filed: Jun. 16, 1999

(51) Int. Cl.[7] ..... B41J 2/165
(52) U.S. Cl. ..... 347/28; 347/25
(58) Field of Search ..... 347/28, 25, 27

(56) References Cited

U.S. PATENT DOCUMENTS

| | | | |
|---|---|---|---|
| 4,296,418 | 10/1981 | Yamazaki et al. . | |
| 4,600,928 | 7/1986 | Braun et al. | 347/27 |
| 4,970,535 * | 11/1990 | Oswald et al. | 347/25 |
| 5,574,485 | 11/1996 | Anderson et al. | 347/27 |
| 5,786,829 | 7/1998 | Pasciak et al. . | |

FOREIGN PATENT DOCUMENTS

| | | | |
|---|---|---|---|
| 52 159226 | 12/1979 | (JP) . | |
| 57 022063 | 2/1982 | (JP) . | |
| 58-173670 * | 10/1983 | (JP) | 347/28 |
| 403236964 * | 10/1991 | (JP) | 347/28 |

* cited by examiner

*Primary Examiner*—N. Le
*Assistant Examiner*—Shih-wen Hsieh
(74) *Attorney, Agent, or Firm*—Walter S. Stevens

(57) ABSTRACT

Multi-fluidic cleaning for an ink jet print head (10) and a method for assembling the same. The print head (10) has a surface (14) defining at least one orifice (16) therethrough, the at least one orifice (16) being susceptible to being obstructed by contaminants. A cleaning assembly (22) of the invention is disposed proximate the surface (14) for directing a flow of fluid along the surface (14) and across the at least one orifice (16) to clean contaminants from the surface (14) and the at least one orifice (16). The cleaning assembly (22) includes a cup (24) sealingly surrounding the at least one orifice (16), the cup (24) defining a cavity (26) therein. The cleaning assembly (22) further includes a valve system (32) in fluid communication with the cavity (26) for allowing a fluid flow stream (44) consisting of alternating segments (46,48,50) of at least one liquid cleaning agent from a liquid cleaning agent source (40,42) and another element such as a gas from a gas source (38) or a second liquid cleaning agent from a liquid cleaning agent source (40,42) into the cavity (26).

16 Claims, 3 Drawing Sheets

MULTI-FLUIDIC CLEANING FOR INK JET PRINT HEADS

FIELD OF THE INVENTION

This invention generally relates to ink jet printer apparatus and methods and more particularly relates to apparatus and methods for cleaning a print head using multiple fluids and a method of assembling the printer.

BACKGROUND OF THE INVENTION

An ink jet printer produces images on a receiver by ejecting ink droplets onto the receiver in an imagewise fashion. The advantages of non- impact, low-noise, low energy use, and low cost operation in addition to the capability of the printer to print on plain paper are largely responsible for the wide acceptance of ink jet printers in the marketplace.

In this regard, "continuous" ink jet printers utilize electrostatic charging tunnels that are placed close to the point where ink droplets are being ejected in the form of a stream. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

In the case of "on demand" ink jet printers, at every orifice a pressurization actuator is used to produce the ink jet droplet. In this regard, either one of two types of actuators may be used. These two types of actuators are heat actuators and piezoelectric actuators. With respect to heat actuators, a heater placed at a convenient location heats the ink and a quantity of the ink will phase change into a gaseous steam bubble and raise the internal ink pressure sufficiently for an ink droplet to be expelled to the recording medium. With respect to piezoelectric actuators, a piezoelectric material is used, which piezoelectric material possesses piezoelectric properties such that an electric field is produced when a mechanical stress is applied. The converse also holds true; that is, an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate.

Inks for high speed ink jet printers, whether of the "continuous" or "piezoelectric" type, must have a number of special characteristics. For example, the ink should incorporate a nondrying characteristic, so that drying of ink in the ink ejection chamber is hindered or slowed to such a state that by occasional spitting of ink droplets, the cavities and corresponding orifices are kept open. The addition of glycol facilitates free flow of ink through the ink jet chamber. Of course, the ink jet print head is exposed to the environment where the ink jet printing occurs. Thus, the previously mentioned orifices are exposed to many kinds of air born particulates. Particulate debris may accumulate on surfaces formed around the orifices and may accumulate in the orifices and chambers themselves. That is, the ink may combine with such particulate debris to form an interference burr that blocks the orifice or that alters surface wetting to inhibit proper formation of the ink droplet. The particulate debris should be cleaned from the surface and orifice to restore proper droplet formation. In the prior art, this cleaning is commonly accomplished by brushing, wiping, spraying, vacuum suction, and/or spitting of ink through the orifice.

Thus, inks used in ink jet printers can be said to have the following problems: the inks tend to dry-out in and around the orifices resulting in clogging of the orifices; and the wiping of the orifice plate causes wear on plate and wiper, the wiper itself producing particles that clog the orifice.

Ink jet print head cleaners are known. An ink jet print head cleaner is disclosed in U.S. Pat. No. 4,970,535 titled "Ink Jet Print Head Face Cleaner" issued Nov. 13, 1990, in the name of James C. Oswald. This patent discloses an ink jet print head face cleaner that provides a controlled air passageway through an enclosure formed against the print head face. Air is directed through an inlet into a cavity in the enclosure. The air that enters the cavity is directed past ink jet apertures on the head face and then out an outlet. A vacuum source is attached to the outlet to create a subatmospheric pressure in the cavity. A collection chamber and removable drawer are positioned below the outlet to facilitate disposal of removed ink. Although the Oswald patent does not disclose use of brushes or wipers, the Oswald patent also does not reference use of a liquid solvent to remove the ink; rather, the Oswald technique uses heated air to remove the ink. However, use of heated air is less effective for cleaning than use of a liquid solvent. Also, use of heated air may damage fragile electronic circuitry that may be present on the print head face. Moreover, the Oswald apparatus does not appear to clean the print head face in a manner that leaves printing speed unaffected by the cleaning operation.

Another ink jet print head cleaner is disclosed in U.S. Pat. No. 4,600,928 by Braun et al. The patent teaches an ink jet printing apparatus which comprises an ultrasonic self cleaning system for cleaning of the print head assembly in which ink is supported in approximation to the orifices of the print head surface by means such as the capillary force. Ultrasonic cleaning pulses are then applied to clean the surface through fluid transmission of that ultrasound energy to said surface. However, this invention requires direct fluid communication between ink and the print head surface for cleaning purposes and it uses ink and not a more effective cleaning solvent for that purpose.

Another ink jet print head cleaner is disclosed in U.S. Pat. No. 5,574,485 by Anderson et al. Anderson patent teaches an ultrasonic liquid wiper for cleaning of a print head surface in which cleaning fluid is brought into close contact with the print head surface by the aid of a cleaning station. Ultrasonic energy in conjunction with the cleaning fluid are then used to dislodge dried ink particles from the print head surface, where they are removed using vacuum nozzles. However, this invention requires a relatively complex cleaning station including apparatus for scanning the liquid wiper across the print head surface.

Therefore, there is a need to provide a self-cleaning printer and method of assembling same, which self-cleaning printer provides effective cleaning without complex cleaning station apparatus.

SUMMARY OF THE INVENTION

An object of the present invention is to provide a self-cleaning printer which provides effective cleaning without complex cleaning station apparatus.

With this object in view, the present invention resides in a self-cleaning printer, comprising a print head having a surface defining at least one orifice therethrough, the at least one orifice being susceptible to being obstructed by contaminants, and a cleaning assembly disposed proximate the surface for directing a flow of fluid along the surface and across the at least one orifice to clean contaminants from the surface and the at least one orifice. The cleaning assembly includes a cup sealingly surrounding the at least one orifice, the cup defining a cavity therein. The cleaning assembly further includes a valve system in fluid communication with the cavity for allowing a fluid flow stream consisting of alternating segments of at least one liquid cleaning agent from a liquid cleaning agent source and at least one other segment into the cavity.

According to an exemplary embodiment of the present invention, the self-cleaning printer comprises a print head defining a plurality of ink channels therein each ink channel terminating in an ink-ejection orifice. The print head also has a surface thereon including an orifice region surrounding all of the orifices. The print head is capable of ejecting ink droplets through the orifices, which ink droplets are intercepted by a receiver (e.g., paper or transparency) supported by a platen roller disposed adjacent the print head. Contaminants such as an oily film-like deposit or particulate matter may reside on the surface and may completely or partially obstruct the orifice. The oily film may, for example, be grease and the particulate matter may be particles of dirt, dust, metal and/or encrustations of dried ink. Presence of the contaminant interferes with proper ejection of the ink droplets from their respective orifices and therefore may give rise to undesirable image artifacts, such as banding. It is therefore desirable to clean the contaminant from the surface.

Therefore, a cleaning assembly is disposed relative to the surface and/or orifice for directing the flow of fluid along the surface and/or across the orifice to clean the contaminant from the surface and/or orifice. As described in detail herein, the cleaning assembly is configured to direct a fluid flow consisting of alternating segments of at least one liquid cleaning agent from a liquid cleaning agent source and a gas from a gas source or a second liquid cleaning agent from a second cleaning agent source into the cavity and across the surface and/or orifice to provide an effective cleaning action.

A feature of the present invention is the provision of a cup sealingly surrounding the at least one orifice, the cup defining a cavity therein through which the flow of fluid is directed along the surface and across the at least one orifice.

Another feature of the present invention is the provision of a fluid flow stream consisting of alternating segments of at least one liquid cleaning agent and a gas, which alternating segments cooperate to remove the contaminants from the surface and/or orifice.

The liquid cleaning agent segments may be solutions of any suitable liquid solvent composition such as water, isopropanol, diethylene glycol, diethylene glycol monobutyl ether, hydrocarbon solvents, fluorocarbon solvents, halogenated solvents, acids and bases, and any combination thereof. Such liquid solutions can, if desired, include additives of all types including surfactants, chelating agents, and the like. Complex fluids such as microemulsions, micellar surfactant solutions, vesicles and solid particles dispersed in liquid may also be used. It is preferable that successive segments of different composition are used. For example, the segments may alternate between cleaning solvents of a first type and a second type, preferably an aqueous-based solvent type and an organic solvent type such as an oil-based solvent, to provide the most effective cleaning action.

By "aqueous-based" cleaning agent it is meant that the liquid in the cleaning agent is substantially composed of water, or water miscible compounds such as but not limited to highly polar alcohols, glycols, esters, ethers, acids and bases or a combination thereof. Complex fluids such as microemulsion, micellar surfactant solutions, vesicles, and solid particles dispersed in aqueous-based carrier liquid can be among the aqueous based cleaning agents.

By oil-based cleaning agent it is meant that the liquid cleaning agent is substantially composed of oil soluble organic liquids such as but not limited to hydrocarbon solvents, fluorocarbon solvents, halogenated solvents, esters, ethers, organic acids, organic bases, and less polar or higher molecular weight alcohols and glycols which are more soluble in oil than the aqueous based type mentioned above, or combinations thereof. Additives such as surfactants, water, acids, bases, salts and polymers may be present without taking away from the function of the cleaning agent. Complex fluids such as microemulsion, micellar surfactant solutions, vesicles, and solid particles dispersed in oil-based carrier liquid can be employed. It is preferred that the number of alternate segments discharged and passing each orifice during each cleaning cycle is in the range of from about 10 to about 1000.

In a preferred embodiment of the present invention, immiscible cleaning liquid segments may be placed adjacent to each other and will not require the presence of an intervening gas segment. For example, an aqueous-based cleaning liquid segment will not mix with an oil-based cleaning agent segment and alternating segments of aqueous- and oil-based agent segments may be employed advantageously for cleaning.

In yet another embodiment, miscible liquid segments may be placed adjacent to each other when conditions permit slight mixing of segments to be tolerated. In any event, the deleterious effects of segment intermixing may be minimized by pushing the liquid segments through the cup and across the print head surface at a high rate of flow that is substantially non-turbulent or laminar.

An advantage of the present invention is that the cleaning assembly belonging to the invention cleans the contaminants from the surface and/or orifice without use of brushes or wipers which might otherwise damage the surface and/or orifice.

Another advantage of the present invention is that the alternating cleaning segments provide a more effective cleaning action afforded in part by the availability of a variety of cleaning agents.

Another advantage of the present invention is that cleaning liquid in each segment may be optimized for a particular contaminant, and will therefore lead to cheaper and easier formulation compared to a cleaning liquid formulated to address a broad variety of contaminants.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
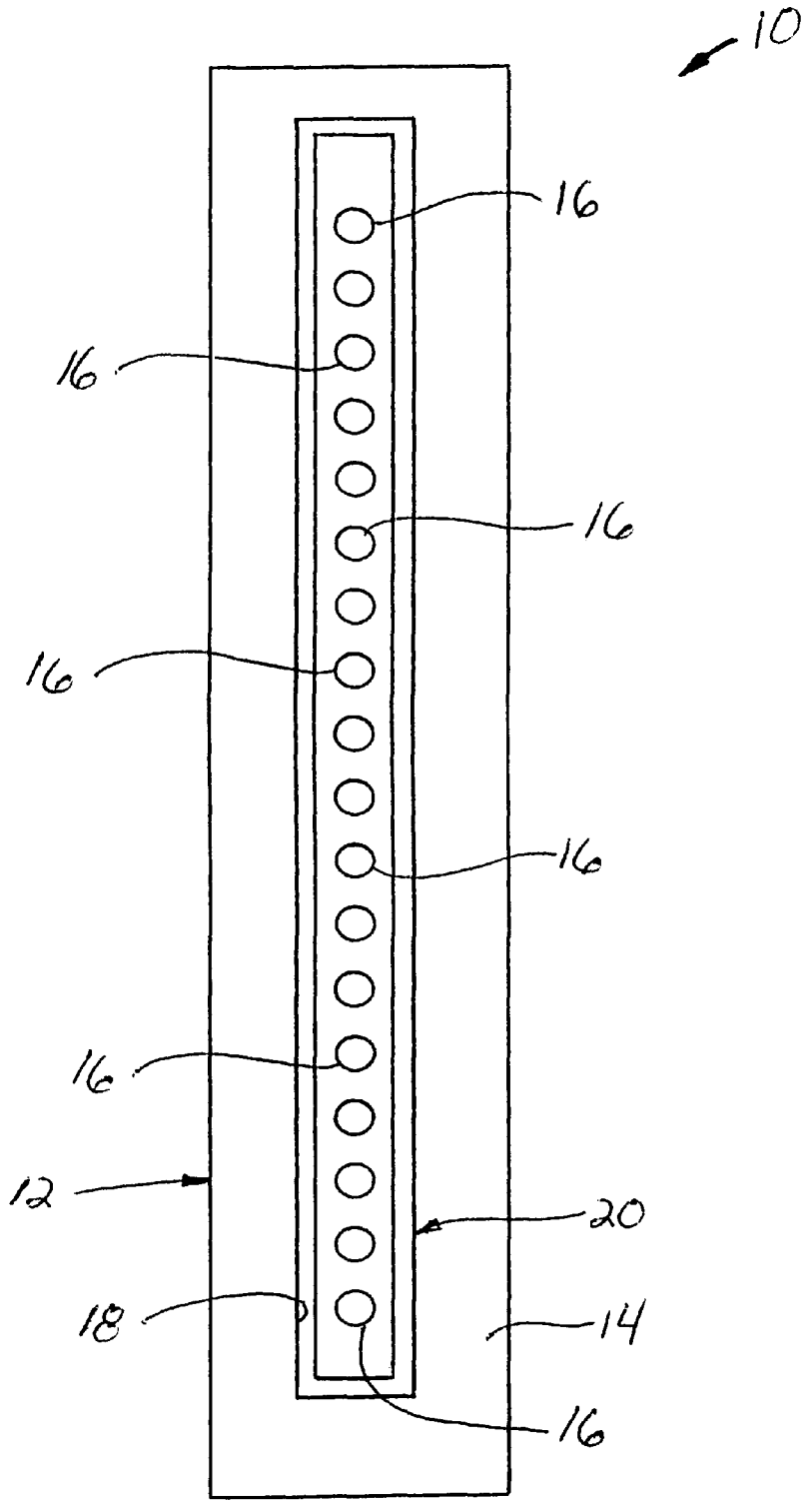
FIG. 1 is a front view of a print head of the self-cleaning ink jet printer belonging to the present invention.

Therefore, referring to FIG. 1, an ink jet print head 10 includes a body 12 of a conventional material, such as, but not limited to, materials used to fabricate CMOS devices. Body 12 has a front surface 14 including a plurality of ink-ejection orifices 16 therein arranged in a linear array. Each ink-ejection orifice 16 extends from surface 14 through the substrate thereof to a respective ink channel (not shown) connected in fluid communication to a supply of ink (also not shown). Print head 10 is conventionally operable to selectively eject ink contained in the respective ink channels through the ink ejection orifices 16 onto a receiver such as a paper or transparency disposed opposite the orifice 16, for instance, using heating elements (not shown) located in front surface 14 which are energized to heat the ink to generate a vapor bubble.

Front surface 14 of print head 10 additionally includes a groove 18 therein extending around ink-ejection orifices 16, groove 18 containing an elastomeric seal member 20 positioned so as to extend no more than a few tens of microns above front surface 14.

Figure 2A:
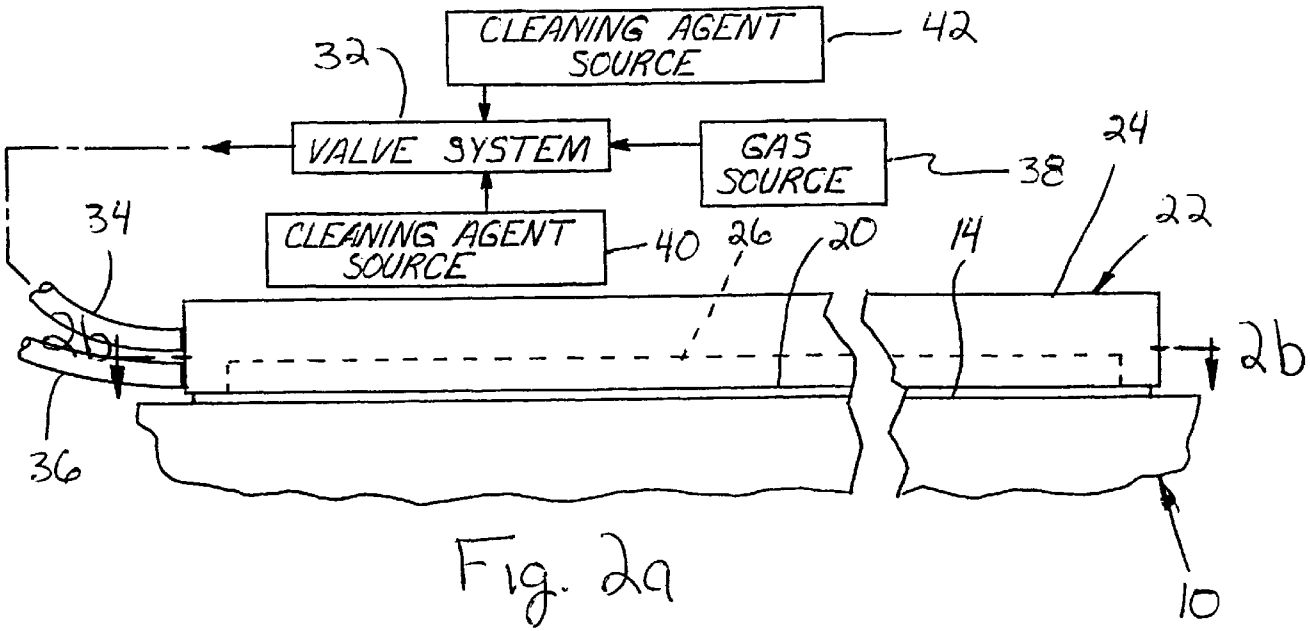
FIG. 2*a* is a side view of the print head of FIG. 1 and a cleaning assembly of the present invention disposed proximate thereto.

FIG. 2*a* is a fragmentary side view of print head 10 showing a cleaning assembly 22 of the present invention disposed proximate to front surface 14. Cleaning assembly 22 includes a cup 24 sealingly engaged with seal member 20 in surrounding relation to ink-ejection orifices 16. Cup 24 and front surface 14 define a cavity 26 in communication with ink-ejection orifices 16.

Figure 2B:
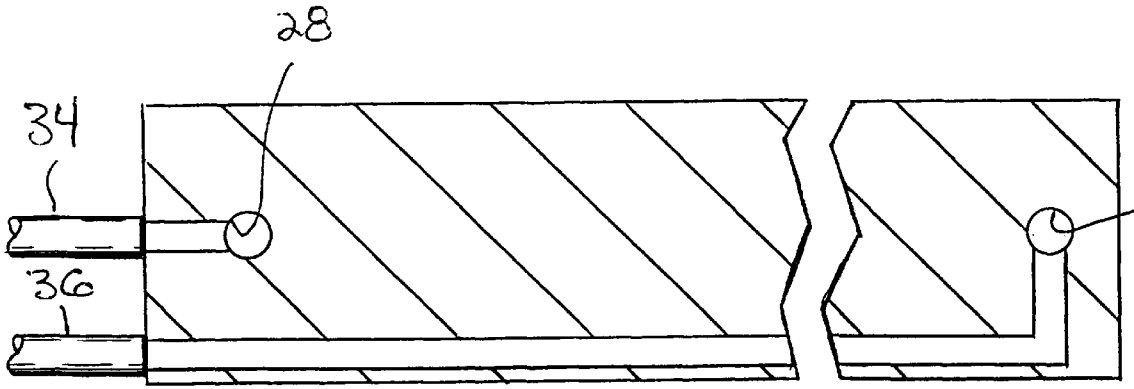
FIG. 2*b* is a sectional view taken along line 2*b*—2*b* of FIG. 2*a;*

Referring also to FIG. 2*b* which is a sectional view of cup 24 taken along line 2*b*—2*b*, cup 24 includes an inlet 28 communicating with cavity 26 positioned to be proximate one end of the array of ink-ejection orifices 16, and an outlet 30 communicating with cavity 26 positioned to be proximate an opposite end of the array of orifices 16. Inlet 28 is connected in fluid communication with a valve system 32 via a supply conduit 34 for supplying a fluid flow stream into cavity 26. Outlet 30 is connected in fluid communication with a receiver (not shown) for the fluid flow stream after it has passed through cavity 26, via a discharge conduit 36.

Valve system 32 is additionally connected in fluid communication with a gas source 38, a first liquid cleaning agent source 40, a second liquid cleaning agent source 42, and is conventionally constructed and operable for selectably and controllably allowing a fluid flow stream consisting of alternating segments of the gas from gas source 38, the first liquid cleaning agent from source 40, and the second liquid cleaning agent from the source 42, into cavity 26 through conduit 34 and inlet 28, under control of a suitable conventional valve controller.

Figure 3:
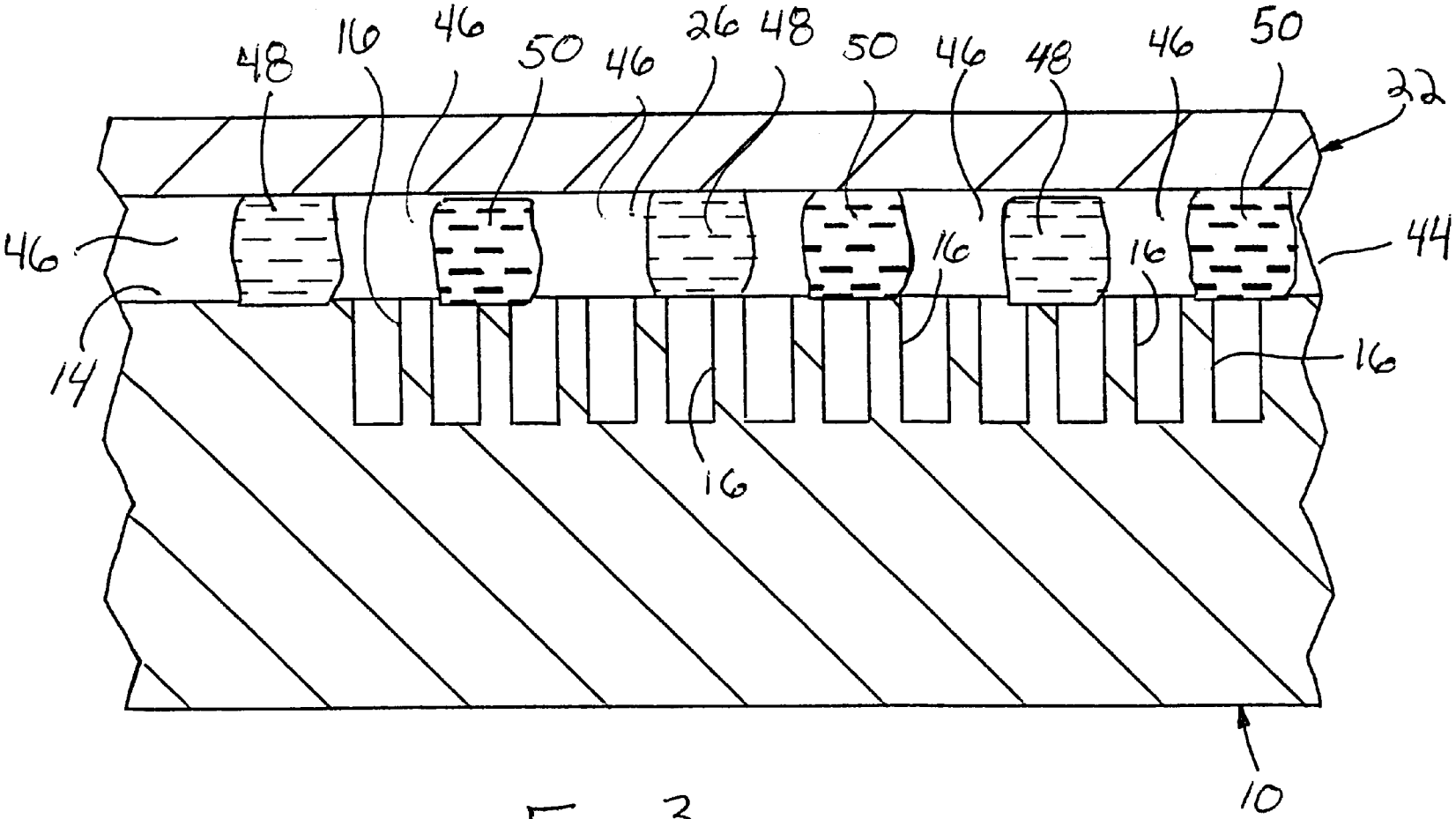
FIG. 3 is a fragmentary sectional view of the print head and cleaning assembly illustrating a flow of fluid through a cavity defined thereby.

Turning also to FIG. 3, which is a fragmentary sectional view of print head 10 and cleaning assembly 22 taken through ink-ejection orifices 16 and cavity 26, a fluid flow stream 44 is shown flowing along surface 14 and across orifices 16 to clean contaminants that may be present thereon and in orifices 16. Fluid flow stream 44 includes alternating segments including segments of gas 46 from source 38, a first liquid cleaning agent 48 from source 40, and segments of a second liquid cleaning agent 50 from source 42.

In an alternative embodiment a fluid flow stream maybe provided flowing along surface 14 and across orifices 16 for cleaning. The fluid flow stream 52 includes alternating segments including segments of first liquid cleaning agent 48 from source 40 and segments of a second liquid cleaning agent 50 from source 42. Gas from gas source 38 is not used.

The liquid cleaning agent segments 48 and 50 may be any suitable liquid solvent composition such as water, isopropanol, diethylene glycol, diethylene glycol monobutyl ether, hexane, heptane, octane, acids and bases, surfactant solutions and any combination thereof. Complex fluids such as microemulsions, micellar surfactant solutions, vesicles and solid particles dispersed in liquid may also be used. It is preferred that segments 48 and 50 differ one to the other in composition, for example, the segments may alternate between a cleaning solvent of a first type and a second type, preferably an aqueous type and an organic solvent type, respectively. In instances wherein the intervening gas segments are not used such as illustrated in FIG. 4, the alternating liquid cleaning 30 agent segments can be substantially immiscible liquids such as an aqueous-based cleaning agent and an oil-based cleaning agent, or miscible liquids if mixing of the segments can be tolerated. Here, mixing may be minimized by using a high liquid flow rate while maintaining non-turbulent or laminar flow. Or, if the selected components are miscible, but not significantly enough to negatively affect the cleaning operation, they can be used. At least one of the cleaning agents preferably contains chemicals in the form of bulk and surfactant additives. As an exemplary combination, one of the segments may be composed of water, one or more detergents and one or more alcohols, and another of the segments may be composed of hexane or heptane. As an additional segment, a gas may be used, including, for example, nitrogen, argon, and helium. It is also preferred that the number of such alternate segments 48 and 50 passing each orifice 16 during each cleaning cycle is in the range of from about 10 to about 1000.

It may be appreciated from the description hereinabove, that cleaning assembly 22 may be supported using any suitable cleaning station support structure allowing it to be separated from print head 10 while print head 10 is in a printing mode, wherein ink is selectively ejected through orifices 16 onto a recording medium, such as paper, transparencies, or the like, in the usual manner. When print head 10 is not in a printing mode, print head 10 or cleaning station 22 can then be moved in a conventional manner for positioning cup 24 of cleaning assembly 22 in sealingly surrounding relation to orifices 16 to provide a moist environment to delay or retard drying of ink thereon, and to prevent the collection of air born particulates such as dust, fibrous material from paper and the like from collecting in and around orifices 16 and contaminating same.

It may be appreciated from the description hereinabove, that another advantage of the present invention is that effective cleaning of surface 14 and orifices 16 can be accomplished using the present apparatus without use of brushes or wipers which might otherwise damage surface 14 and/or orifices 16. While the invention has been described with particular reference to its preferred embodiment, it will be understood by those skilled in the art that various changes may be made and equivalents may be substituted for elements of the preferred embodiment without departing from the invention. For instance, print head 10 may be constructed of any of a wide variety of alternative conventional materials, such as, but not limited to, piezoelectric materials and the like. In addition, many modifications may be made to adapt a particular situation and material to a teaching of the present invention without departing from the essential teachings of the invention. For an example, inlet 28, outlet 30, supply conduit 34 and/or discharge conduit 36 may be alternatively located in body 12 of print head 10, and seal member 20 may be alternative located on cup 24. As another example, print head 10 may be movable relative cleaning assembly 22 between a cleaning position and a printing position, instead of cleaning assembly 22 moving relative to the print head.

Therefore, what is provided is a multi-fluidic cleaning for a print head of an ink printer, and a method of assembling the printer.

| PARTS LIST | |
|---|---|
| 10 | printhead |
| 12 | body |
| 14 | front surface |
| 16 | ink-ejection orifice |
| 18 | groove |
| 20 | seal member |
| 22 | cleaning assembly |
| 24 | cup |
| 26 | cavity |
| 28 | inlet |
| 30 | outlet |
| 32 | valve system |
| 34 | supply conduit |
| 36 | discharge conduit |
| 38 | gas source |
| 40 | first liquid cleaning agent source |
| 42 | second liquid cleaning agent source |
| 44 | fluid flow stream |
| 46 | gas segment |
| 48 | liquid cleaning agent segment |
| 50 | liquid cleaning agent segment |
| 52 | fluid flow stream |

What is claimed is:

1. A self-cleaning printer, comprising:

(a) a print head having a surface defining at least one orifice therethrough, the at least one orifice being susceptible to being obstructed by contaminants; and (b) a cleaning assembly disposed proximate the surface for directing a flow of fluid along the surface and across the at least one orifice to clean contaminants from the surface and the at least one orifice, said assembly including:

(i) a cup sealingly surrounding the at least one orifice, said cup defining a cavity therein; and (ii) a valve system in fluid communication with the cavity for allowing a fluid flow stream consisting of alternating segments of at least one liquid cleaning agent from a liquid cleaning agent source and at least one other segment into the cavity, said other segment or segments being selected from the group consisting of a gas, an additional liquid cleaning agent, and combinations thereof.

2. The self-cleaning printer of claim 1, wherein the print head comprises a plurality of the orifices arranged in a linear array.

3. The self-cleaning printer of claim 2, wherein the cup includes an inlet in fluid communication with the valve system for introducing the fluid flow stream into the cavity adjacent one end of the array and an outlet for discharging the stream adjacent an opposite end of the array.

4. The self-cleaning printer of claim 1, wherein the fluid flow stream consists of alternating segments of one liquid cleaning agent, at least one additional liquid cleaning agent and a gas.

5. The self-cleaning printer of claim 1, wherein the fluid flow stream consists of alternating segments of the at least one liquid cleaning agent and at least one additional liquid cleaning agent.

6. The self-cleaning printer of claim 1, wherein the at least one liquid cleaning agent is an aqueous-based cleaning agent and the at least one other segment is an oil-based liquid cleaning agent.

7. The self-cleaning printer of claim 1, wherein the at least one liquid cleaning agent is an oil-based cleaning agent and the at least one other segment is an oil-based liquid cleaning agent.

8. The self-cleaning printer of claim 1, wherein the at least one liquid cleaning agent is an aqueous-based cleaning agent, and the at least one other segment is also an aqueous-based liquid cleaning agent.

9. A method of assembling a self-cleaning printer, comprising the steps of:

(a) providing a print head having a surface defining at least one orifice therethrough, the at least one orifice being susceptible to being obstructed by contaminants;

(b) providing a cleaning assembly for directing a flow of fluid along the surface and across the at least one orifice to clean contaminants from the surface and the at least one orifice, said assembly including:

(i) a cup to be disposed in sealed surrounding relation to the at least one orifice, said cup defining a cavity therein; and (ii) a valve system to be disposed in fluid communication with the cavity for allowing a fluid flow stream consisting of alternating segments of at least one liquid cleaning agent from a liquid cleaning agent source and at least one other element from another source into the cavity.

10. The method of claim 9, wherein the fluid flow stream consists of alternating segments of a first liquid cleaning agent from a first liquid cleaning agent source and a second liquid cleaning agent from a second liquid cleaning agent source.

11. The method of claim 10, wherein the fluid flow stream additionally consists of segments of a gas from a gas source.

12. A method for cleaning a printer, comprising:

(a) providing a print head having a surface defining at least one orifice thereon, the at least one orifice being susceptible to being obstructed by contaminants; and (b) disposing a cleaning assembly proximate to the surface for directing a flow of fluid along the surface and across the at least one orifice to clean contaminants from the surface and the at least one orifice, said flow of fluid consisting of alternating segments of at least one liquid cleaning agent and at least one other element.

13. The method of claim 12, wherein the flow of fluid consists of alternating segments of two liquid cleaning agents and a gas.

14. The method of claim 12, wherein the flow of fluid consists of alternating segments of two liquid cleaning agents.

15. The method of claim 12, wherein the flow of fluid consists of alternating segments of a liquid cleaning agent and a gas.

16. The method of claim 12, wherein the flow of fluid is directed through a cup sealingly surrounding the at least one orifice.

* * * * *